US006207636B1

(12) United States Patent
Benjamin et al.

(10) Patent No.: US 6,207,636 B1
(45) Date of Patent: Mar. 27, 2001

(54) PROCESS FOR PREPARING A LOW TFM DETERGENT BAR COMPOSITION

(75) Inventors: Rajapandian Benjamin, Bangalore; Sudhakar Yeshwant Mhaskar; Subhash Shivshankar Mhatre, both of Mumbai, all of (IN)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/458,193

(22) Filed: Dec. 9, 1999

(30) Foreign Application Priority Data

| | | |
|---|---|---|
| Dec. 14, 1998 | (IN) | 810/BOM/98 |
| Dec. 14, 1998 | (IN) | 811/BOM/98 |
| Mar. 24, 1999 | (GB) | 9906834 |
| Mar. 24, 1999 | (GB) | 9906835 |

(51) Int. Cl.[7] ..... C11D 17/00

(52) U.S. Cl. ..... 510/458; 510/447; 510/450; 510/508

(58) Field of Search ..... 510/447, 450, 510/458, 508

(56) References Cited

U.S. PATENT DOCUMENTS 2,677,665 5/1954 James .

FOREIGN PATENT DOCUMENTS

| | | |
|---|---|---|
| 0825252 | 2/1998 | (EP) . |
| 2235930 | 3/1991 | (GB) . |
| 2247463 | 3/1992 | (GB) . |
| 2263282 | 7/1993 | (GB) . |
| 0176384 * | 1/1994 | (IN) . |

* cited by examiner

*Primary Examiner*—Necholus Ogden
(74) *Attorney, Agent, or Firm*—Ronald A. Koatz

(57) ABSTRACT

A low total fatty matter content detergent bar composition comprising a surfactant 25–70% total fatty matter, 9–16% by weight colloidal aluminium hydroxide and 12–52% water. The invention also comprises a process for preparing a detergent bar comprising a surfactant, 25–70% total fatty matter, 0.5–20% colloidal aluminium hydroxide and 15–52% water, comprising the steps of reacting one or more fatty acids or fats with sodium aluminate with a solid content of 20–55% wherein the $Al_2O_3$ to $Na_2O$ ratio is in the region 0.5–1.55:1 to obtain a mixture of aluminium hydroxide and soap at a temperature of between 40° C. and 95° C., adding a predetermined amount of water to the mixture of aluminium hydroxide and soap, adding any further minor additives, and converting the product into bars.

21 Claims, No Drawings

PROCESS FOR PREPARING A LOW TFM DETERGENT BAR COMPOSITION

The invention relates to a synergistic composition of soap/detergent bars for personal or fabric washing. This invention particularly relates to an improved detergent bar composition with a low total fatty matter (TFM) having superior sensory and physical properties. In a further aspect, the invention also relates to a process for the preparation of the soap/detergent bars, and in particular an improved process for preparing a low total fatty matter detergent bar.

Conventional detergent bars, based on soap for personal washing contain over about 70% by weight TFM, the remainder being water (about 10–20%) and other ingredients such as colour, perfume, preservatives, etc. Structurants and fillers are also present in such compositions in small amounts which replace some of the soap in the bar while retaining the desired hardness of the bar. A few known fillers include starch, kaolin and talc.

Hard non-milled soaps containing moisture of less than 35% are also available. These bars have a TFM of about 30–65%. The reduction in TFM has been achieved by the use of insoluble particulate materials and/or soluble silicates.

Milled bars generally have a water content about 8–15% and the hard non-milled bars have a water content of about 20–35%.

Swiss patent 226570 (1943) teaches the use of colloidal alumina hydrate mixed with "powdered soap wort roots" and Na-naphthalene sulphonate. Colloidal alumina gels in presence of water form a hard homogeneous mass that can be packed and sold. However this refers to a cast bar.

IN 176384 discloses a detergent composition with low TFM content having high ratio of water to TFM without affecting hardness, cleaning and lathering properties of the bar by the incorporation of up to 20% colloidal aluminium hydroxide (A-gel). The A-gel/TFM combination enabled the preparation of bars with higher water content while using TFM at a lower level. This document also discloses a process wherein by providing a balanced combination of aluminium hydroxide and TFM it is possible to prepare a low TEM bar having high water content but with satisfactory hardness. The application teaches the generation of colloidal alumina hydrate in-situ by a reaction of fatty acid or an acid precursor of an active detergent with an aluminium containing alkaline material such as sodium aluminate to form bars which are obtained by plodding.

In this teaching, although the A-gel concentration disclosed is up to 20% by weight, the demonstration of the invention is restricted to the use of 7.5% by weight A-gel in combination with 40 TFM with an additional structurant such as 5% by weight of alkaline silicate.

It has now been found that when A-gel is used below 9.0% by weight a bar with good processability cannot be prepared without having additional structurants and/or increasing the TFM. However, bars with A-gel above 16.0% by weight would be very difficult to process, and affect the sensory and physical properties adversely.

Further, it has also been found that in situ generation of aluminium hydroxide by a reaction of fatty acid or an acid precursor of an active detergent with an aluminium containing alkaline material such as sodium aluminate solution that specifically has a solid content of 20 to 55% wherein the alumina ($Al_2O_3$) to sodium oxide ($Na_2O$) is in a ratio of 0.5 to 1.55 by weight gives superior bar properties. These bars have improved hardness and smoother feel. This reaction can take place in a broader temperature range of 40 to 95° C.

Thus according to a first aspect of the invention, there is provided a low TFM content detergent composition with superior sensory and physical properties comprising:

25 to 70% by weight of total fatty matter;

9.0 to 16% by weight of colloidal aluminium hydroxide (A-gel);

from 12 to 52% by weight of water; and optionally other liquid benefit agents and the balance being other conventional ingredients.

According to a further aspect, there is provided an improved process for preparing a low TFM detergent bar comprising from 25 to 70% by weight of total fatty matter, from 0.5 to 20% by weight of colloidal aluminium hydroxide (A-gel), from 15 to 52% by weight of water and the balance being other and minor additives as herein described, which process comprises the steps of:

a. reacting one or more fatty acids or fats such as herein described with an aluminium containing alkaline material, such as sodium aluminate with a solid content of 20 to 55% and wherein the $Al_2O_3$ to $Na_2O$ is in a ratio of 0.5 to 1.55:1, to obtain a mixture of aluminium hydroxide and soap at a temperature between 40° C. to 95° C.;

b. adding a predetermined amount of water to the mixture of aluminium hydroxide and soap;

c. adding if desired, other and minor additives such as herein described to the mixture of step (b)

d. converting the product of step (c) into bars by a conventional method.

The term total fatty matter, usually abbreviated to TFM, is used to denote the percentage by weight of fatty acid and triglyceride residues present, without taking into account the accompanying cations.

For a soap having 18 carbon atoms, an accompanying sodium cation will generally amount to about 8% by weight. Other cations may be employed as desired, for example zinc, potassium, magnesium, alkyl ammonium and aluminium.

The term soap denotes salts of carboxylic fatty acids. The soap may be derived from any of the triglycerides conventionally used in soap manufacture—consequently the carboxylate anions in the soap may contain from 8 to 22 carbon atoms.

The soap may be obtained by saponifying a fat and/or a fatty acid. The fats or oils generally used in soap manufacture may be such as tallow, tallow stearines, palm oil, palm stearines, soya bean oil, fish oil, caster oil, rice bran oil, sunflower oil, coconut oil, babassu oil, palm kernel oil, and others. In the above process the fatty acids are derived from oils/fats selected from coconut, rice bran, groundnut, tallow, palm, palm kernel, cotton seed, soybean, castor etc. The fatty acid soaps can also be synthetically prepared (e.g. by the oxidation of petroleum, or by the hydrogenation of carbon monoxide by the Fischer-Tropsch process). Resin acids, such as those present in tall oil, may be used. Naphthenic acids are also suitable.

Tallow fatty acids can be derived from various animal sources, and generally comprise about 1–8% myristic acid, about 21–32% palmitic acid, about 14–31% stearic acid, about 0–4% palmitoleic acid, about 36–50% oleic acid and about 0–5% linoleic acid. A typical distribution is 2.5% myristic acid, 29% palmitic acid, 23% stearic acid, 2% palmitoleic acid, 41.5% oleic acid, and 3% linoleic acid. Other mixtures with similar distribution, such as those from palm oil, and those derived from various animal tallow and lard are also included.

Coconut oil refers to fatty acid mixtures having an approximate carbon chain length distribution of 8% $C_8$, 7%

$C_{10}$, 48% $C_{12}$, 17% $C_{14}$, 8% $C_{16}$, 2% $C_{18}$, 7% oleic and 2% linoleic acids (the first six fatty acids listed being saturated). Other sources having similar carbon chain length distributions, such as palm kernel oil and babassu kernel oil, are included within the term coconut oil.

According to a further preferred aspect, the invention provides an improved process for preparing a low TFM detergent bar comprising:

a. reacting one or more fatty acids such as are herein described with an aluminium containing alkaline material such as sodium aluminate, with a solid content of 20 to 55%, wherein the $Al_2O_3$ to $Na_2O$ is in a ratio of 1.0 to 1.55:1, in presence of 0.5–2% by weight of a solubility stabilizer to obtain a mixture of aluminium hydroxide and soap at a temperature between 40° C. to 95° C.;

b. adding predetermined amount of water to the mixture of aluminium hydroxide and soap;

c. adding if desired, other and minor additives such as are herein described to the mixture of step (b);

d. converting the product of step (c) into bars by a conventional method.

The solubility stabilizer is conveniently selected from any soluble inorganic or organic salts, polymers, other alkaline materials, alkali metal salt of citric, tartaric, gluconic acids, polyvinyl alcohol, etc. The most preferred solubility stabilizer is potassium chloride.

According to a preferred aspect of the invention, up to 30% of other liquid benefit agents such as non-soap surfactants, skin benefit materials such as moisturisers, emollients, sunscreens, anti-ageing compounds are incorporated at any step prior to step of milling. Alternatively certain of these benefit agents may be introduced as macro domains during plodding.

The particle size of aluminium hydroxide may range from 0.1 to 25 $\mu$m, and preferably have an average particle size of 2 to 15 $\mu$m, and most preferably 7 $\mu$m.

Fatty Acid

A typical suitable fatty acid blend consists of 5 to 30% coconut fatty acids and 70 to 95% fatty acids, ex. hardened rice bran oil. Fatty acids derived from other suitable oils/fats such as groundnut, soybean, tallow, palm, palm kernel, etc. may also be used in other desired proportions.

Aluminium Containing Alkaline Material

It is preferable to generate the aluminium hydroxide in situ during the saponification of the fats/fatty acids. One or more fats/fatty acids may be saponified with an aluminium containing alkaline material, such as sodium aluminate with a solid content of 20 to 55%, preferably 30 to 55% and wherein the $Al_2O_3$ to $Na_2O$ is in a ratio of 0.5 to 1.55:1, preferably 1.0 to 1.5:1, to obtain a mixture of aluminium hydroxide and soap at a temperature between 40° C. to 95° C., preferably between 60 and 95° C. A solubility stabilizer may be selected from any soluble inorganic or organic salts, polymers, other alkaline materials, alkali metal salt of citric, tartaric, gluconic acids, polyvinyl alcohol, etc. may additionally be incorporated. The most preferred solubility stabilizer is potassium chloride.

In certain embodiments, in particular those relating to the process of the invention, it may be preferable that a soluble inorganic salt be present to improve the quality of the aluminium hydroxide formed, which inorganic salt may preferably be potassium chloride.

Commercially available aluminium hydroxide with a particle size distribution of 2 to 40 $\mu$m, or that prepared by the reaction of a mineral acid such as hydrochloric acid with sodium aluminate solution can be incorporated.

Benefit Agents

The non-soap surfactants may be anionic, nonionic, cationic, amphoteric or zwitterionic or a mixture thereof. Examples of moisturisers and humectants include polyols, glycerol, cetyl alcohol, Carbopol 934, ethoxylated castor oil, paraffin oils, lanolin and its derivatives. Silicone compounds such as silicone surfactants like DC3225C (Dow Corning) and/or silicone emollients, silicone oil (DC-200 Ex-Dow Corning) may also be included. Sun-screens such as 4-tertiary butyl-4'-methoxy dibenzoylmethane (available under the trade name PARSOL 1789 from Givaudan), and/or 2-ethyl hexyl methoxy cinnamate (available under the trade name PARSOL MCX from Givaudan), or other UV-A and UV-B sun-screens may also be included.

Other Additives

Other additives such as one or more water insoluble particulate materials such as talc, kaolin, polysaccharides such as starch or modified starch as described in our patent application IN 175386 may also be incorporated.

Minor Additives

In step (c) of the process according to the invention, minor additives such as perfume, colour, preservatives and other conventional additives at levels typically of around 1 to 2% by weight can be incorporated.

Non-Soap Detergents

The composition according to the invention will preferably comprise detergent actives, which are generally chosen from both anionic and nonionic detergent actives.

Suitable anionic detergent active compounds are water soluble salts of organic sulphuric reaction products having in the molecular structure an alkyl radical containing from 8 to 22 carbon atoms, and a radical chosen from sulphonic acid or sulphuric acid ester radicals and mixtures thereof.

Examples of suitable anionic detergents are sodium and potassium alcohol sulphates, especially those obtained by sulphating the higher alcohols produced by reducing the glycerides of tallow or coconut oil; sodium and potassium alkyl benzene sulphonates such as those in which the alkyl group contains from 9 to 15 carbon atoms; sodium alkyl glyceryl ether sulphates, especially those ethers of the higher alcohols derived from tallow and coconut oil; sodium coconut oil fatty acid monoglyceride sulphates; sodium and potassium salts of sulphuric acid esters of the reaction product of one mole of a higher fatty alcohol and from 1 to 6 moles of ethylene oxide; sodium and potassium salts of alkyl phenol ethylene oxide ether sulphate with from 1 to 8 units of ethylene oxide molecule and in which the alkyl radicals contain from 4 to 14 carbon atoms; and the reaction product of fatty acids esterified with isethionic acid and neutralised with sodium hydroxide where, for example, the fatty acids are derived from coconut oil and mixtures thereof.

The preferred water-soluble synthetic anionic detergent active compounds are the alkali metal (such as sodium and potassium) and alkaline earth metal (such as calcium and magnesium) salts of higher alkyl benzene sulphonates and mixtures with olefin sulphonates and higher alkyl sulphates, and the higher fatty acid monoglyceride sulphates. The most preferred anionic detergent active compounds are higher alkyl aromatic sulphonates, such as higher alkyl benzene sulphonates containing from 6 to 20 carbon atoms in the alkyl group in a straight or branched chain, particular examples of which are sodium salts of higher alkyl benzene sulphonates or of higher-alkyl toluene, xylene or phenol sulphonates, alkyl naphthalene sulphonates, ammonium diamyl naphthalene sulphonate, and sodium dinonyl naphthalene sulphonate.

Suitable nonionic detergent active compounds can be broadly described as compounds produced by the condensation of alkylene oxide groups, which are hydrophilic in nature, with an organic hydrophobic compound which may be aliphatic or alkyl aromatic in nature. The length of the hydrophilic or polyoxyalkylene radical which is condensed with any particular hydrophobic group can be readily adjusted to yield a water-soluble compound having the desired degree of balance between hydrophilic and hydrophobic elements.

Particular examples include the condensation product of aliphatic alcohols having from 8 to 22 carbon atoms in either straight or branched chain configuration with ethylene oxide, such as a coconut oil ethylene oxide condensate having from 2 to 15 moles of ethylene oxide per mole of coconut alcohol; condensates of alkylphenols whose alkyl group contains from 6 to 12 carbon atoms with 5 to 25 moles of ethylene oxide per mole of alkylphenol; condensates of the reaction product of ethylenediamine and propylene oxide with ethylene oxide, the condensate containing from 40 to 80% of polyoxyethylene radicals by weight and having a molecular weight of from 5,000 to 11,000; tertiary amine oxides of structure $R_3NO$, where one group R is an alkyl group of 8 to 18 carbon atoms and the others are each methyl, ethyl or hydroxyethyl groups, for instance dimethyldodecylamine oxide; tertiary phosphine oxides of structure $R_3PO$, where one group R is an alkyl group of from 10 to 18 carbon atoms, and the others are each alkyl or hydroxyalkyl groups of 1 to 3 carbon atoms, for instance dimethyldodecylphosphine oxide; and dialkyl sulphoxides of structure $R_2SO$ where the group R is an alkyl group of from 10 to 18 carbon atoms and the other is methyl or ethyl, for instance methyltetradecyl sulphoxide; fatty acid alkylolamides; alkylene oxide condensates of fatty acid alkylolamides and alkyl mercaptans.

It is also possible to include amphoteric, cationic or zwltterionic detergent actives in the compositions according to the invention.

The reaction step (a) is typically conducted at a temperature of 40–95° C., more preferably between 60 and 95° C. The sequence of the reaction step (a) is critical, and it Is preferred to add fatty acids to sodium aluminate.

The bar is made by conventional methods, e.g. by the frame cooling method or by extrusion (plodding) method. Typically, in the extrusion method, fatty acids are neutralised with sodium aluminate, either as such or in the presence of non-soap detergent active, a few selected additives added, and the dried to the required moisture. The dried soap is then mixed with remaining minor additives/non-soap detergents if not added earlier in the mixer, mechanically worked in triple roll mill and plodded under vacuum in the form of billets. The billets are later stamped in the form of bars.

The soap/detergent bars produced according to the present invention have been found to demonstrate excellent visual appearance, feel, hardness, cleaning and lathering properties.

Illustrations of a few non-limiting examples are provided herein by way of illustration only showing comparative results of the compositions and processes according to the present invention, and outside the scope of the invention.

EXAMPLES 1–3

Suitable bar composition details and their properties are shown in Table 1.

TABLE 1

| | Composition (parts wt.) | | |
|---|---|---|---|
| | Example 1 | Example 2 | Example 3 |
| TFM | 62 | 66 | 56 |
| Soda ash | 0.5 | 0.5 | 0.5 |
| Moisture | 19.0 | 19.0 | 19.0 |
| Colloidal aluminium hydroxide | 12.4 | 8.0 | 18 |
| Minor ingredients | 0.8 | 0.8 | 1.5 |
| Product Characteristics | | | |
| Yield stress (Pa.) | $3.3 \times 10^5$ | Too soft | Very hard |
| Feel | 7.5 | — | 8.7 |

The samples prepared as described above were tested for hardness (Yield stress) and feel (grittiness) by the following procedure.

Yield Stress:

Yield stress quantifies the hardness of a soap bar. The yield stress of the bars at a specified temperature was determined by observation of the extent to which a bar was cut by a weighted cheese wire during a specified time. The apparatus consists of a cheesewire (diameter d in cm) attached to a counter balanced arm which can pivot freely via a ball race bearing. A billet of soap is positioned under the wire such that the wire is just in contact with one edge of the billet. By applying a weight (W g.) directly above the cheesewire, a constant force is exerted on the wire which will slice into the soap. The area over which the force acts will increase as the depth of cut increases, and therefore the stress being exerted will decrease until it is exactly balanced by resistance of the soap and the wire stops moving. The stress at this point is equal to the yield stress of the soap. The time taken to reach this point was found to be 30 seconds, so that a standard time of 1 min. was chosen to ensure that the yield stress had been reached. After this time the weight was removed, and the length of the cut (L in cm) measured. The yield stress is calculated using the semi-empirical formula:

$$Y \cdot S = \frac{3W}{8} \times \frac{98.1}{L \times d} \text{ Pascal (Pa.)}$$

Feel

A standard washing procedure in cold water is followed for estimation of grittiness by feel by a group of trained panellists. The score is given over scale of 1–10, where score of 1 relates to the best feel and 10 to the poorest. The toilet soaps with acceptable quality generally have a feel score in the range of 7.8 to 8.0.

The data presented in table 1 show that the physical properties of the bar such as hardness, and processability are adversely affected when the content of the colloidal aluminium hydroxide is outside the range as defined according to the invention. The bars according to the invention had a superior feel score, the bars according to Example 2 were too soft to process, and the bars according to Example 3 were very hard and gritty.

EXAMPLES 4–6

Examples 4–6 demonstrate processes according to the invention, comparing compositions prepared conventionally, without the addition of any aluminium hydroxide, and also those prepared using aluminium hydroxide where the specific ratio of $Al_2O_3$:$Na_2O$ in the sodium aluminate was varied.

Process for Preparing the Soap Bar:

a. Conventional process:

A batch of 50 kg soap was prepared by melting a mixture of fatty acids at 80–85° C. in a crutcher and neutralising with 48% sodium hydroxide solution in water. Additional water was added to obtain a moisture content of about 33%. The soap mass was spray dried under vacuum, and formed into noodles. The soap noodles were mixed with soda ash, talc, perfume, colour, and titanium dioxide in a sigma mixer, and passed twice through a triple roll mill. The milled chips were plodded under vacuum and formed into billets. The billets were cut and stamped into tablets.

b. Process According to Prior Art:

A batch of 50 kg soap was prepared by melting a mixture of fatty acids at 80–85° C. in a crutcher and neutralising with 40% sodium aluminate solution. The sodium aluminate solution was prepared by dissolving solid sodium aluminate in water at 90–95° C. Additional water was added to obtain a moisture content of about 36%. The soap mass was spray dried under vacuum, and formed into noodles. The soap noodles were mixed with soda ash, perfume, colour, and titanium dioxide in a sigma mixer, and passed twice through a triple roll mill. The milled chips were plodded under vacuum and formed into billets. The billets were cut and stamped into tablets.

c. Process According to the Invention:

A batch of 50 kg soap was prepared by melting a mixture of fatty acids at 80–85° C. in a crutcher, and neutralising with 40% sodium aluminate solution. The sodium aluminate solution was prepared by dissolving solid alumina trihydrate in sodium hydroxide solution at 90–95° C. Additional water was added to obtain a moisture content of about 36%. The soap mass was spray dried under vacuum, and formed into noodles. The soap noodles were mixed with soda ash, perfume, colour, and titanium dioxide in a sigma mixer and passed twice through a triple roll mill. The milled chips were plodded under vacuum, and formed into billets. The billets were cut and stamped into tablets.

The samples prepared as described above were tested for hardness (yield stress) and feel (grittiness) as described above.

Results

TABLE 2

| | Composition (parts wt). | | |
|---|---|---|---|
| | Example 4 (Invention) | Example 5 (Prior art) | Example 6 (Control) |
| TFM | 62 | 62 | 68 |
| Soda ash | 0.5 | 0.5 | 0.5 |
| Talc | — | — | 11.0 |
| Moisture | 19.0 | 19.0 | 13.2 |
| Colloidal aluminium hydroxide $Al_2O_3$: $Na_2O$ = 1.1 | 12.4 | — | — |
| Colloidal aluminium hydroxide $Al_2O_3$: $Na_2O$ = 1.66 | — | 12.4 | — |
| Minor ingredients | 0.8 | 0.8 | 1.5 |
| Product Characteristics | | | |
| Yield stress (Pa.) | $3.3 \times 10^5$ | $3.2 \times 10^5$ | $3.0 \times 10^5$ |
| Feel | 7.5 | 8.4 | 8.0 |

The data presented shows that in spite of increasing the moisture content of the bar to 19.0 as compared to the control with a moisture content of 13.2, and eliminating the filler content completely, the hardness of the bar was not affected significantly. However, as compared to the control and bars prepared according to the prior art, the feel of the soap according to the invention is significantly superior. The panellists gave the tars according to the invention significantly lower grit scores as compared to the control bars.

EXAMPLES 7–11

The following compositions were prepared as outlined above:

| | Parts/wt. | | | | |
|---|---|---|---|---|---|
| Component | 7 | 8 | 9 | 10 | 11 |
| TFM | 62 | 67 | 62 | 72 | 55 |
| Aluminium hydroxide | 12 | 7 | 7 | 7 | 18 |
| Water | 20 | 20 | 20 | 15 | 20 |
| Talc | 0 | 0 | 5 | 0 | 0 |
| Penetration Value (mm at 35° C.) | 4.1 | 5.3 | 5.0 | 4.2 | 4.0 |
| Yield stress (kPa at 35°) | 190 | 130 | 150 | 200 | 200 |

In relation to the bars produced, example 7 is within the scope of the invention, whilst examples 8–10 have levels of aluminium hydroxide below the required level. Example 11 has an aluminium hydroxide level above that of the claimed invention.

In terms of the bars'properties, bars containing a lower amount of aluminium hydroxide were found to be more susceptible to water loss, and may also in some circumstances be more prone to higher levels of mush. Bars containing relatively high levels of aluminium hydroxide were susceptible to cracking.

Further, it was found that if the aluminium hydroxide level dropped below about 8%, the soap bar can become too soft (ie it has low yield stress and high penetration values), and at a given water content be relatively difficult to process.

In such bars, the addition of 5% talc improved the hardness, but not sufficiently. Bar hardness could be improved only by lowering the water content and increasing TFM, but with a consequent increase in the cost of the product. At a given water content, dropping the aluminium hydroxide level below 8% led to an increase in mush, which could be alleviated by adding talc or reducing the water content.

When the aluminium hydroxide content is increased above about 16%, at a given water content the bar may retain processability, but it was found to have a aritty feel. Such relatively high aluminium hydroxide content bars also demonstrated significant cracking, a Decreased rate of wear, and also severe efflorescence on storage.

What is claimed is:

1. A low total fatty matter content detergent bar composition comprising 25–70% total fatty matter, 9–16% by weight colloidal aluminum hydroxide and 12–57% water;

wherein one step in a process for making said bar comprises reacting one or more fatty acids or fats with sodium aluminate having a solid content of 20–55%; wherein the $Al_2O_3$ to $Na_2O$ ratio is in the region 0.5 to 1.55:1.

2. A detergent bar as claimed in claim 1, wherein the fatty matter comprises fatty acid and/or triglyceride residues.

3. A detergent bar as claimed in claim 1, wherein the composition additionally comprises up to 30% by weight of liquid benefit agents selected from non-soap surfactants, skin benefit materials, emollients, sunscreens or anti-ageing compounds.

4. A detergent bar as claimed in claim 3, wherein the liquid benefit agent is added to the bar composition at any stage.

5. A detergent bar as claimed in claim 3, wherein the liquid benefit agent is introduced into the bar composition as macro domains during plodding.

6. A detergent bar as claimed in claim 1, wherein the composition comprises tallow fatty acids and/or coconut oil.

7. A detergent bar as claimed in claim 1, wherein the aluminium hydroxide has a particle size of 0.1–25 $\mu$m.

8. A detergent bar as claimed in claim 1, wherein the fatty acid blend consists of 5–30% coconut fatty acids and 70–95% hardened rice bran oil fatty acids.

9. A detergent bar as claimed in claim 1, wherein the aluminium hydroxide is generated in situ during saponification.

10. A detergent bar as claimed in claim 1, additionally comprising a solubility stabilizer selected from soluble organic or inorganic salts, polymers, polyvinyl alcohol, alkaline materials, and alkali metal salts of citric, tartaric, or gluconic acids.

11. A detergent bar as claimed in claim 10, wherein the solubility stabilizer is potassium chloride.

12. A detergent bar as claimed claim 1, wherein the surfactant is an anionic or nonionic surfactant.

13. A process for preparing a detergent bar comprising a surfactant, 25–70% total fatty matter, 9–16% colloidal aluminium hydroxide and 15–52% water, comprising the steps of:

a) reacting one or more fatty acids or fats with sodium aluminate with a solid content of 20–55% wherein the $Al_2O_3$ to $Na_2O$ ratio is in the region 0.5–1.55:1, to obtain a mixture of aluminium hydroxide and soap at a temperature of between 40° C. and 95° C.;

b) adding a predetermined amount of water to the mixture of aluminium hydroxide and soap;

c) adding any further minor additives, and d) converting the product of step (c) into bars.

14. A process as claimed in claim 13, wherein the soap is formed from tallow fatty acids and/or coconut oil.

15. A process as claimed in claim 13, wherein 0.5–2% by weight of a solubility stabilizer is added during step (a).

16. A process as claimed in any of claim 13, wherein the solubility stabilizer is selected from soluble organic or inorganic salts, polymers, alkaline metals, poly vinyl alcohol and alkali metal salts of citric, tartaric, or gluconic acids.

17. A process as claimed in claim 13, wherein during the process there is added to the composition up to 30% by weight of a liquid benefit agent selected from non-soap surfactants, skin benefit materials, emollients, sunscreens, or anti-ageing compounds, or mixtures thereof.

18. A process as claimed in claim 13, wherein the particle size of the aluminium hydroxide ranges from 0.1 to 25 $\mu$m.

19. A process as claimed in claim 13, wherein the fatty acid comprises a blend of 5–30% coconut fatty acid and 70–95% hardened rice bran oil fatty acids.

20. A process as claimed in claim 13, wherein the ratio of $Al_2O_3$ to $Na_2O$ in step (a) is in the region 1.0–1.5:1.

21. A process as claimed in claim 13, wherein the reaction temperature in step (a) is 60–95° C.

* * * * *